US005782122A

United States Patent [19]

Köppel

[11] Patent Number: 5,782,122

[45] Date of Patent: Jul. 21, 1998

[54] SPINNING ROLLER FOR SPLITTING A ROTATIONALLY SYMMETRICAL WORKPIECE

[76] Inventor: Jürgen Köppel, Im Lehmkühlchen 24, D-59269 Beckum, Germany

[21] Appl. No.: 733,300

[22] Filed: Oct. 17, 1996

Related U.S. Application Data

[63] Continuation-in-part of Ser. No. 703,332, Aug. 26, 1996, which is a continuation of Ser. No. 372,943, Jan. 17, 1995, abandoned.

[30] Foreign Application Priority Data

Oct. 26, 1994 [DE] Germany ..... 44 38 112.3

[51] Int. Cl.[6] ..... B21B 27/06

[52] U.S. Cl. ..... 72/71

[58] Field of Search ..... 72/211, 210, 204, 72/203, 252.5, 71, 83; 492/1, 2, 3

[56] References Cited

U.S. PATENT DOCUMENTS

| | | | |
|---|---|---|---|
| 2,379,584 | 7/1945 | Litton | 72/71 |
| 3,566,503 | 3/1971 | Pacak . | |
| 3,700,382 | 10/1972 | Pacak | 72/83 |
| 4,040,281 | 8/1977 | Meyer | 72/82 |
| 4,302,958 | 12/1981 | Andriessen et al. | 72/71 |
| 4,523,446 | 6/1985 | Muller | 72/71 |
| 4,532,786 | 8/1985 | Schaible . | |
| 4,551,122 | 11/1985 | Kraft et al. | 72/83 |
| 4,936,129 | 6/1990 | Lipper et al. . | |

FOREIGN PATENT DOCUMENTS

| | | |
|---|---|---|
| 0 127 997 | 12/1984 | European Pat. Off. . |
| 1206838 | 7/1966 | Germany . |
| 232 210 | 1/1986 | Germany . |
| 39 32 823 | 12/1990 | Germany . |
| 39 31 599 | 2/1991 | Germany . |
| 2 187 406 | 9/1987 | United Kingdom . |

*Primary Examiner*—Joseph J. Hail, III
*Assistant Examiner*—Rodney Butler
*Attorney, Agent, or Firm*—Hill & Simpson

[57] ABSTRACT

A spinning roller for splitting rotationally symmetrical workpieces on a spinning machine is provided. The spinning roller is formed as a double splitting roller having two splitting edges arranged at a distance from one another in the axial direction of the spinning roller. A groove is provided between the two splitting edges. The groove is laterally bounded by a flank of the two splitting edges. To form specifically-shaped workpieces, the spinning roller can be alternatively formed of selected component parts including a first splitting edge, a second splitting edge and a spacer located between the two splitting edges.

16 Claims, 4 Drawing Sheets

SPINNING ROLLER FOR SPLITTING A ROTATIONALLY SYMMETRICAL WORKPIECE

DESCRIPTION OF RELATED APPLICATIONS

This application is a Continuation-in-Part of application U.S. Ser. No. 08/703,332 filed on Aug. 26, 1996 (Attorney Docket No. P94,2905-B), which is a continuation of patent application U.S. Ser. No. 08/372,943, filed Jan. 17, 1995, (now abandoned).

BACKGROUND OF THE INVENTION

The present invention is generally directed to spinning rollers and more specifically to a spinning roller for carrying out splitting processes on rotationally symmetrical workpieces on a spinning machine.

Spinning rollers are known in various embodiments. The spinning rollers of this sort each have a splitting edge. By means of a spinning roller of this sort, the rotationally symmetrical workpiece can be split starting from its outer circumference in a radial direction from the outside in. The workpiece can thus be divided into two parts in its outer area. These two parts can then be brought to a desired final form through further transformations. The finally processed workpiece may be, for example, a pulley having a belt support surface formed by the two parts of the previously split area of the workpiece. Splitting rollers are also used for the manufacture of many other workpieces by means of spinning, as is familiar to one skilled in the art.

For some workpieces it is necessary to perform several splitting operations, and the position of the split may also be asymmetrical with respect to the axial direction of the workpiece. For workpieces of this type, several splitting operations must be carried out sequentially. Thus, means for supporting the workpiece are required. In the case of an asymmetrical position of the split, the support means are required to avoid unwanted deformations of the workpiece and to ensure a sufficient precision of the split course. This requires an increased expenditure of time and machinery.

SUMMARY OF THE INVENTION

To this end, the present invention provides a spinning roller of the type described above that avoids the named disadvantages and with which workpieces requiring several splitting operations can be processed in a technologically simpler and faster way.

This task is inventively solved by a spinning roller constructed as a double splitting roller having two splitting edges arranged at a distance from one another in the axial direction of the spinning roller. An open groove is left free between the two splitting edges. The groove is laterally defined and bounded by a flank of each of the two splitting edges.

The inventive spinning roller offers the advantage of permitting two splitting processes to be carried out on one workpiece in one operation. As a result, the expenses of time and machinery for this task are considerably reduced. The part of the workpiece remaining between the splits produced during a splitting process performed using the inventive spinning roller is accepted by the groove left open between the splitting edges in the spinning roller, so that this remaining part does not hinder the advancing of the spinning roller. The split depth achievable using the spinning roller depends only on the depth of the groove between the two neighboring splitting edges.

In an embodiment of the spinning roller, the flanks laterally bounding the groove run parallel to one another. In this way, support of the workpiece on the groove flanks over the entire radial length of the groove is achieved. This embodiment is particularly advantageous in the case of an asymmetrical distribution of material on both sides of the split. In fact, this embodiment provides the advantage, in certain circumstances, of making such a splitting process possible at all.

An alternative embodiment of the spinning roller provides that the flanks laterally bounding the groove in the radial direction of the spinning roller have a decreasing taper from the groove outward. Using a spinning roller constructed in this way, the workpiece finds support only in the immediate area of the edge tips of the two splitting edges; however, the mutual sliding friction between the spinning roller on the one side and the workpiece on the other side is considerably decreased. As a result, the spinning process can be carried out with a lower power outlay and with less wear.

Each of the flanks of the two splitting edges of the inventive spinning roller turned away from the groove may be variously embodied. In order to achieve a good cutting effect of the splitting edges and at the same time to protect the cutting edges sufficiently against wear, it is provided that an angle $\alpha$ enclosed by the flanks of the splitting edges at the edge tips is smaller than 30 degrees and larger than 10 degrees.

A further embodiment of the spinning roller provides that the splitting edge tips are rounded off. This type of roller is suited in particular for use with soft material or for use subsequent to a splitting roller provided with sharp edges. Here it is preferred that the rounding-off radius of the splitting edge tips is about 1/100 to 1/200 of the maximal spinning roller radius.

In order to simplify the manufacture of the inventive spinning roller and to enable the spinning roller to be easily and quickly adaptable to different conditions of use, the spinning roller can be assembled from several rotationally symmetrical spinning roller parts that can be separated from one another. The individual spinning roller parts can thus be produced independently and subsequently combined to form the desired spinning roller.

In such an embodiment, it is preferably provided that a first spinning roller part comprises the first of the two splitting edges, a second spinning roller part comprises the second of the two splitting edges and a third spinning roller part comprises a spacer arranged between the first and second spinning roller part. In this way the edge geometries of the two splitting edges of the spinning roller, as well as the spacing, measured in the axial direction between the two splitting edges of the spinning roller, can be chosen independently of one another and arbitrarily combined with one another. As an advantageous result, a separate complete spinning roller does not have to be produced for every application, but rather a uniquely constructed spinning roller can be assembled from a selection of different spinning roller parts. This embodiment thereby saves manufacturing and investment costs, and simplifies warehousing requirements.

In their simplest embodiment, the inventive spinning rollers are constructed as mirror images, symmetrically to a radial mid-plane. Alternatively, however, the radii and/or the flank shapes and/or the splitting edge tip angles of the two splitting edges may also be different from one another.

Exemplary embodiments of the inventive spinning roller are described with reference to the drawings.

DETAILED DESCRIPTION OF THE PREFERRED EMBODIMENTS

Figure 1:
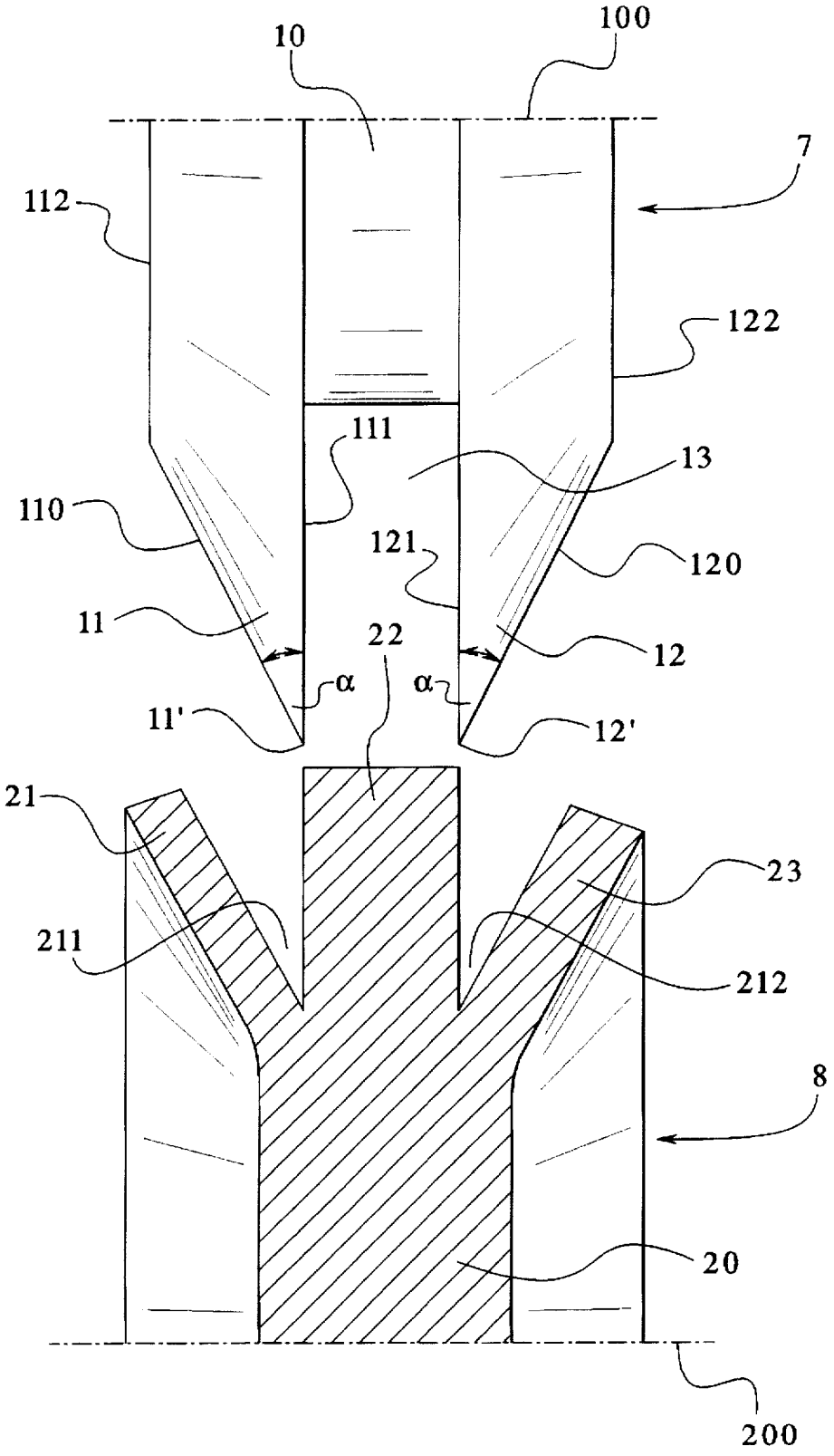
FIG. 1 is a side view of an embodiment of a first spinning roller with a cross-section of a workpiece to be processed by it, wherein only half of the spinning roller and the workpiece above and below the relevant axes of rotation is shown.

FIG. 1 shows a first exemplary embodiment of a spinning roller 7 referred to as a double splitting roller. The spinning roller 7 is formed in a rotationally symmetrical manner around its mid axis 100. The spinning roller 7 has bearings (not shown) so that it rotates about this mid axis 100 during use. The arrangement of the bearings are not specifically represented, since they are familiar to one skilled in the art.

The spinning roller 7 has two splitting edges 11, 12, terminating in splitting edge tips 11', 12'. The splitting edge 11 is bounded by an outer flank 110 and an inner flank 111. The splitting edge 11 is also bounded by an outer surface 112. The inner flanks 111, 121 are both arranged perpendicular to the mid axis 100 of the spinning roller 7. Similarly, the splitting edge 12 is bounded by an outer flank 120 and an inner flank 121, as well as an outer surface 122. The outer flank 110 and the inner flank 111 terminate at the splitting edge tip 11' to form an angle α therebetween. In like fashion, the outer flank 120 and the inner flank 121 terminate at the splitting edge tip 12' to also from an angle α therebetween.

A cylindrical spacer section 10 is located between the splitting edges 11 and 12 in the center of the spinning roller 7. The cylindrical spacer section 10 has an outer diameter less than the diameter of the splitting edges 11, 12 such that a groove 13 is formed between the splitting edges 11, 12. The groove 13, which opens radially outwardly from the mid axis 100, is defined by the outer circumference of the cylindrical section 10 and the two inner flanks 111, 121 which face one another. As a result, the groove 13 has a basically rectangular cross-section in the embodiment shown.

Beneath the spinning roller 7 shown at the top of FIG. 1, an upper half of a rotationally symmetrical workpiece 8 to be processed using the spinning roller 7 is shown in section. Prior to processing, the workpiece 8 was originally a flat, rotationally symmetrical cylindrical blank. Performing a splitting process using the spinning roller 7 to impinge on the original cylindrical blank causes a splitting of the workpiece 8. Two splits 211, 212 are thereby formed in the workpiece 8. The splits 211, 212 begin at the outer circumference of the workpiece 8. Two resulting wings 21, 23 are turned outward from the radial plane. As the wings 21, 23 are formed by the splitting edges 11, 12 a middle circumference area 22 remains in the workpiece 8. The workpiece 8 is unformed in the circumference area 22 lying between the wings 21, 23.

As illustrated in FIG. 1, the inner flanks 111, 121 of the two splitting edges 11 and 12 run parallel to one another, so that the groove 13 has a rectangular shape. The spinning roller 7 thereby supports itself at the middle circumference area 22 of the workpiece 8 when penetrating into the workpiece 8 during a splitting operation. The geometry of the spinning roller 7 provides for a maximal equilibrium of forces in the axial direction of the workpiece 8. Thus, neutral behavior of the spinning roller 7 is achieved even during asymmetrical splitting. A displacement of the spinning roller 7 in the axial direction relative to the workpiece 8 is prevented in this way. Through precise design of the spinning roller geometry, the equilibrium of forces can be optimized for every application.

As described above, FIG. 1 further shows that the two outer flanks 110, 120 of the two splitting edges 11, 12 that face outward extend perpendicular to the mid axis 100 of the spinning roller 7. The outer flanks 110, 120 each enclose the acute angle α with the corresponding inward-facing inner flank 111 or 121. This angle α a preferably between about 10 and 30 degrees. Correspondingly, the wings 21, 23 also run essentially at the same angle α relative to the middle circumference area 22 of the workpiece 8. In a central area 20 of the workpiece 8, lying near an axis of symmetry and rotation 200, the workpiece 8 still has its original form corresponding to that of the original material. A known holding and turning means for the workpiece 8 are not specifically represented here, but would provide rotation of the workpiece 8 along the axis of symmetry and rotation 200.

Figure 2:
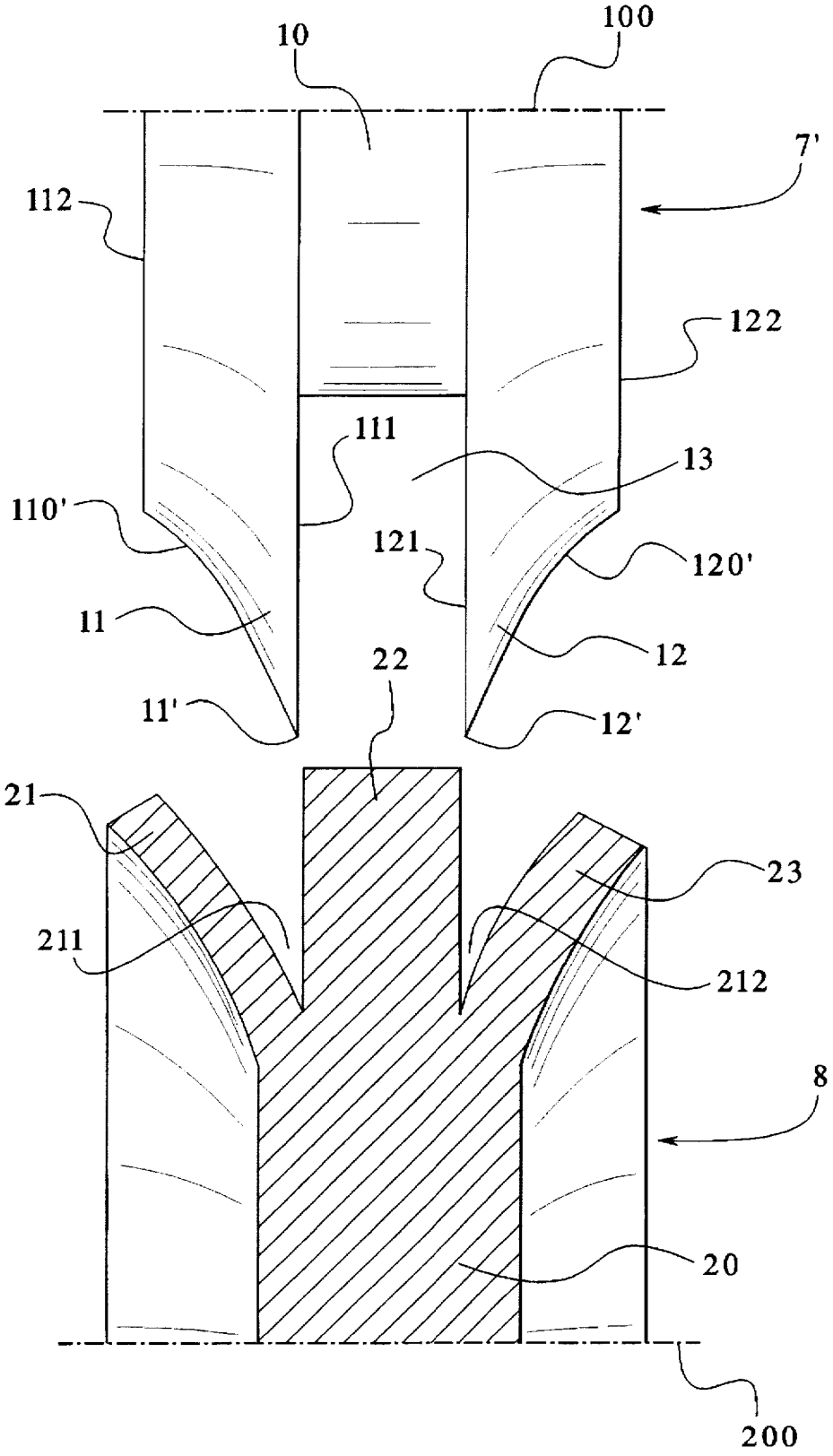
FIG. 2 is a side view of a second embodiment of a spinning roller with a workpiece to be processed by it shown in the same manner as in FIG. 1.

FIG. 2 shows a second embodiment of the spinning roller 7' wherein like parts are represented by like numerals. The spinning roller 7' consists of the two splitting edges 11 and 12 and the cylindrical part 10 lying between them. In contrast to the exemplary embodiment according to FIG. 1, in the spinning roller 7' shown in FIG. 2, the outer flanks 110', 120' of the two splitting edges 11, 12 are contoured. Beginning from the edge tips 11', 12', they run at first in a straight line at an acute angle to the inward-facing flanks 111, 121, and subsequently run further in a concave curve.

Corresponding to the geometry of the splitting edges 11', 12', the wings 21, 23 split off from the workpiece 8 by using the spinning roller 7' also receive a corresponding form. The resulting splits 211, 212 produced in the workpiece 8 essentially correspond with the contour of the splitting edges 11, 12, as shown in the bottom part of FIG. 2. The remaining reference numbers correspond to the description of FIG. 1.

Figure 3:
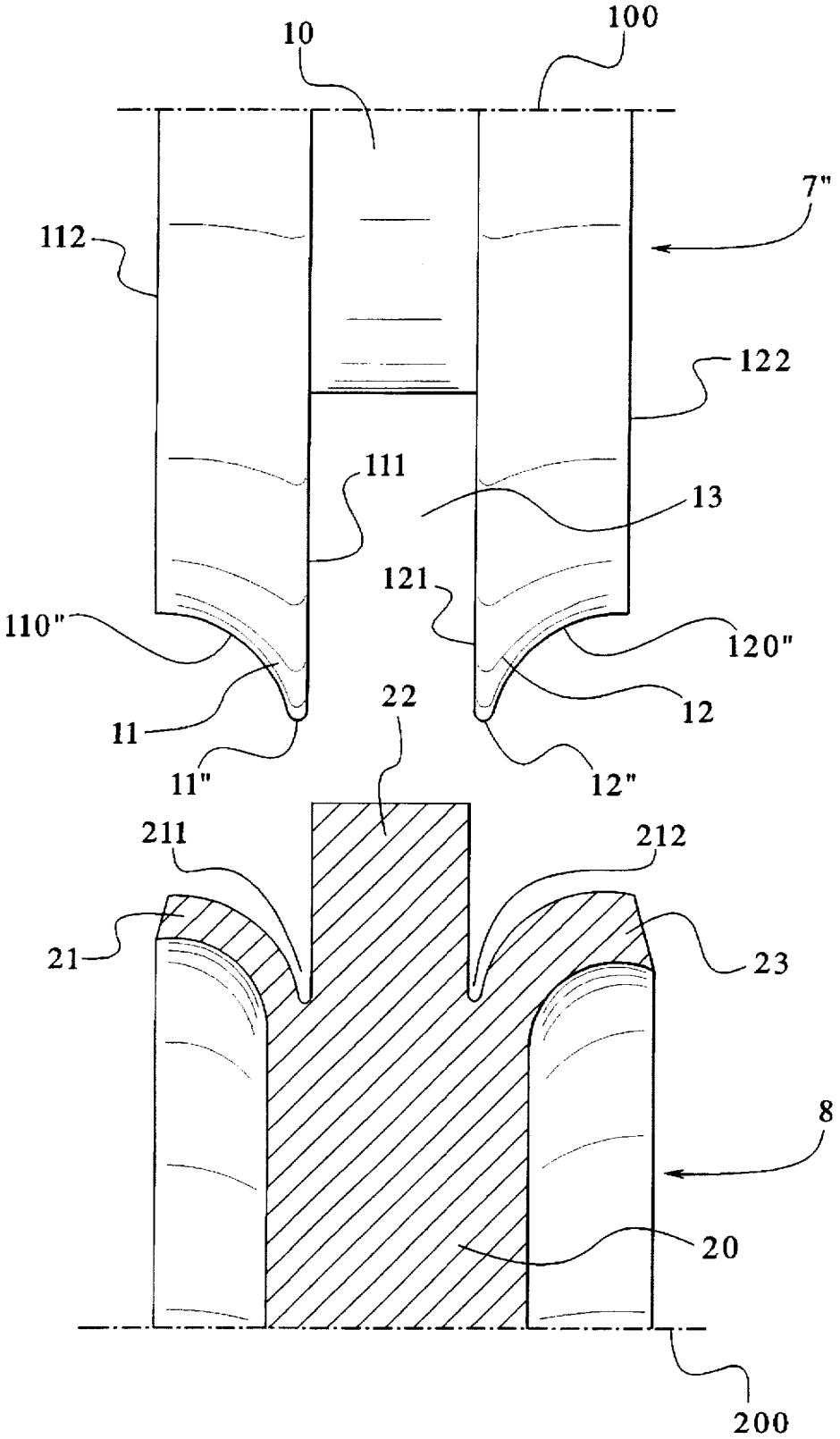
FIG. 3 is a side view of a third embodiment of a spinning roller with a workpiece to be processed by it shown in the same manner as in FIG. 1.

FIG. 3 shows a third exemplary embodiment of the spinning roller 7". In this embodiment of the spinning roller 7", the splitting edges 11, 12 are formed with rounded-off tips 11", 12". Moreover, the outward-facing outer flanks 110", 120" of the two splitting edges 11", 12" are constructed with a concave curve over their entire length. This spinning roller 7" is particularly suited for use as an expanding roller. For example, by using this spinning roller 7", splits 211, 212 produced previously by a spinning roller according to FIG. 1 or FIG. 2 can be expanded, and the wings 21, 23 can be further turned down and thus further formed.

After the production of the two splits 211, 212, the workpiece 8 can be further formed as desired by means of further forming steps, in particular by means of further spinning operations. As a result, the workpiece 8 can be further processed into a finished product. This finished product may for example be a transmission or coupling part for an automotive vehicle.

Figure 4:
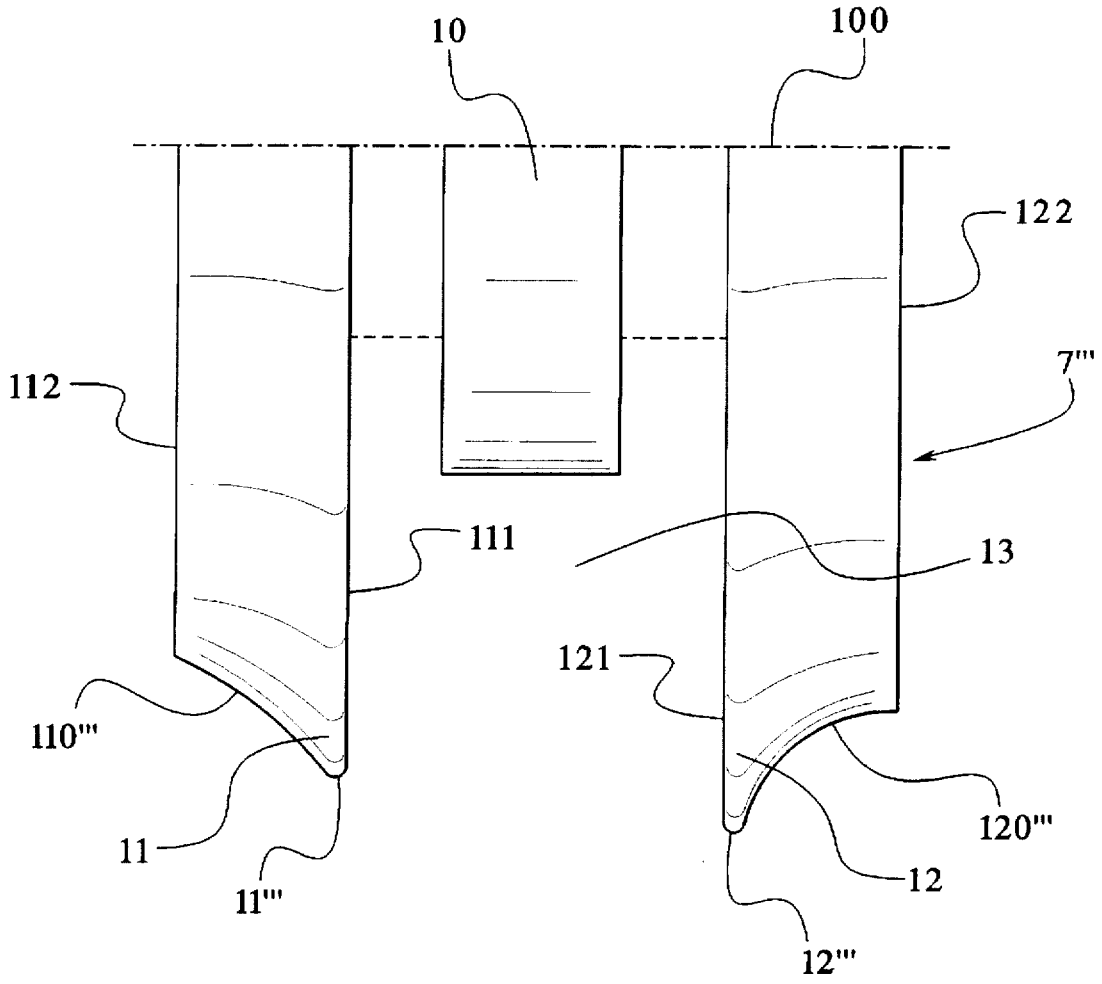
FIG. 4 is a side view of an embodiment of a modular spinning roller of the present invention.

The spinning rollers 7, represented in FIGS. 1 to 3, can be formed in one piece or, alternatively as shown in FIG. 4, assembled from several spinning roller parts. In the represented exemplary embodiments of the spinning roller 7, 7', 7" the three spinning roller parts assembled would then consist of the first splitting edge 11, the second splitting edge 12 and the cylindrical part 10 arranged between them, serving as a spacer. These parts may be detachably connected (as shown in FIG. 4) with one another in a known manner, e.g. screwing. Various particular needs can be met in a simple manner by selecting the appropriate components. Through the exchange of the spacer 10, for example, different edge spacings can be implemented while continuing to use the two splitting edges 11 and 12. Such a modular arrangement provides the above mentioned advantages. For example, the inventory of specific prefabricated spinning rollers can be kept to a minimum since any specifically required roller can be assembled using relatively few staple component roller parts to meet the specific need at hand.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A spinning roller for splitting a rotationally symmetrical workpiece on a spinning machine, comprising:

a double splitting roller having an axis of symmetry and rotation with a first splitting edge and a second splitting edge arranged along said axis at a distance from one another separated by a spacer, each splitting edge having an inner flank extending a radial distance from and perpendicular to the axis and an outer flank arranged at an angle relative to the inner flank such that the inner flank and the outer flank form an asymmetrical splitting edge tip therebetween;

a groove located between the two splitting edges laterally defined and bounded by the inner flanks of the two splitting edges and the spacer; and an outer surface formed on each splitting edge.

2. The spinning roller according to claim 1, wherein the inner flanks that laterally define and bound the groove are parallel to one another.

3. The spinning roller according to claim 1, wherein each outer surface formed on each splitting edge is parallel to one another.

4. The spinning roller according to claim 1, wherein the outer flank of the splitting edge extends from the tip to the outer surface of the splitting edge so that the outer flank has a radial distance from the axis of the double splitting roller which decreases from the tip to the outer surface.

5. The spinning roller according to claim 1, wherein the outer flank of the splitting edge extends from the tip in a straight line and at an acute angle to the respective inner flank.

6. The spinning roller according to claim 1, wherein the outer flank of the splitting edge forms an acute angle with the respective inner flank of the splitting edge, the outer flank initially extending in a straight line from the tip, and subsequently extending in a concave curve to the outer surface.

7. The spinning roller according to claim 1, wherein the outer flank of the splitting edge forms an acute angle with the respective inner flank of the splitting edge, the outer flank extending in a concave curve from the tip to the outer surface.

8. The spinning roller according to claim 1, wherein the angle is between 10 and 30 degrees.

9. The spinning roller according to claim 1, the tips formed by the inner and outer flanks are rounded.

10. The spinning roller according to claim 1, further comprising:

a plurality of separable, rotationally symmetrical spinning roller parts assembled together to form the double splitting roller.

11. The spinning roller according to claim 1, wherein the tip formed by the inner and outer flanked of the first splitting edge differs from that of the tip of second splitting edge.

12. The spinning roller according to claim 1, wherein the radial distance of the inner flank of the first splitting edge differs from that of the main flank of the second splitting edge.

13. The spinning roller according to claim 1, wherein the outer flank of the first splitting edge differs from that of the second splitting edge.

14. The spinning roller according to claim 1, wherein the outer flank of the first splitting edge has a first shape and the outer flank of the second splitting edge has a second shape.

15. The spinning roller according to claim 8, wherein the rounded tips have a radius of approximately 1/100 to 1/200 of a maximal radius of the spinning roller.

16. The spinning roller according to claim 1, wherein the spacer is adjacent to the first and second splitting edges and positioned along the axis of symmetry and rotation of the double splitting roller.

* * * * *